US011186900B2

(12) United States Patent
Hirashima et al.

(10) Patent No.: US 11,186,900 B2
(45) **Date of Patent: *Nov. 30, 2021**

(54) HIGH-STRENGTH COLD ROLLED STEEL SHEET AND METHOD FOR MANUFACTURING THE SAME

(71) Applicant: JFE Steel Corporation, Tokyo (JP)

(72) Inventors: Takuya Hirashima, Tokyo (JP); Kenji Kawamura, Tokyo (JP); Yoshihiko Ono, Tokyo (JP); Yuma Honda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 196 days.

This patent is subject to a terminal disclaimer.

(21) Appl. No.: 16/493,166

(22) PCT Filed: Mar. 8, 2018

(86) PCT No.: PCT/JP2018/008892

§ 371 (c)(1),
(2) Date: Sep. 11, 2019

(87) PCT Pub. No.: WO2018/168618

PCT Pub. Date: Sep. 20, 2018

(65) Prior Publication Data

US 2020/0071802 A1 Mar. 5, 2020

(30) Foreign Application Priority Data

Mar. 13, 2017 (JP) ..... JP2017-047361

(51) Int. Cl.

| | |
|---|---|
| ***C22C 38/04*** | (2006.01) |
| ***C21D 8/02*** | (2006.01) |
| ***C22C 38/22*** | (2006.01) |
| ***C22C 38/24*** | (2006.01) |

(52) U.S. Cl.

CPC ..... *C22C 38/04* (2013.01); *C21D 8/0205* (2013.01); *C21D 8/0236* (2013.01); *C22C 38/22* (2013.01); *C22C 38/24* (2013.01); *C21D 2211/002* (2013.01); *C21D 2211/008* (2013.01)

(58) Field of Classification Search

CPC ..... C21D 1/26; C21D 1/78; C21D 2211/002; C21D 2211/005; C21D 2211/008; C21D 8/0236; C21D 8/0247; C21D 9/46; C22C 38/001; C22C 38/02; C22C 38/38

USPC ..... 420/120; 148/336

See application file for complete search history.

(56) References Cited

U.S. PATENT DOCUMENTS

| | | | | |
|---|---|---|---|---|
| 8,993,120 | B2 | 3/2015 | Kawata et al. | |
| 11,001,906 | B2 * | 5/2021 | Kawamura | C22C 38/005 |
| 2012/0247625 | A1 | 10/2012 | Shimamura et al. | |
| 2014/0234659 | A1 | 8/2014 | Kawata et al. | |
| 2017/0029914 | A1 | 2/2017 | Hayashi | |
| 2017/0314116 | A1 | 11/2017 | Kawata et al. | |
| 2018/0002771 | A1 * | 1/2018 | Han | C21D 8/0226 |
| 2018/0080100 | A1 | 3/2018 | Kawamura et al. | |
| 2018/0195143 | A1 | 7/2018 | Shimori et al. | |

FOREIGN PATENT DOCUMENTS

| | | | |
|---|---|---|---|
| CN | 103305762 | A | 9/2013 |
| CN | 103842543 | A | 6/2014 |
| CN | 105861943 | A | 8/2016 |
| CN | 107614731 | A | 1/2018 |
| EP | 2246456 | A1 | 11/2010 |
| EP | 2692895 | A1 | 2/2014 |
| JP | 2007138262 | A | 6/2007 |
| JP | 2010070843 | A | 4/2010 |
| JP | 2011094230 | A | 5/2011 |
| JP | 5240037 | B2 | 7/2013 |
| JP | 2013181183 | A | 9/2013 |
| JP | 2014005514 | A | 1/2014 |
| WO | 2013047760 | A1 | 4/2013 |
| WO | 2015080242 | A1 | 6/2015 |
| WO | 2016072479 | A1 | 5/2016 |
| WO | 2016157257 | A1 | 10/2016 |
| WO | 2016194272 | A1 | 12/2016 |
| WO | 2017038070 | A1 | 3/2017 |

OTHER PUBLICATIONS

Chinese Office Action with Search Report for Chinese Application No. 201880017606.2, dated Dec. 17, 2020, 9 pages.

International Search Report and Written Opinion for International Application No. PCT/JP2018/008892, dated May 29, 2018—5 pages.

Extended European Search Report for European Application No. 18767644.0, dated Jan. 7, 2020, 8 pages.

* cited by examiner

*Primary Examiner* — Jie Yang
(74) *Attorney, Agent, or Firm* — RatnerPrestia

(57) ABSTRACT

A high-strength cold rolled steel sheet having mechanical characteristics having a tensile strength of not less than 780 MPa, a yield ratio of not more than 70%, and a small in-plane anisotropy of a tensile characteristicis obtained by hot rolling a steel slab comprising by mass % C: 0.07 to 0.12%, Si: not more than 0.7%, Mn: 2.2 to 2.8% and Ti and Nb: 0.02 to 0.08% in total, and cold rolling the sheet, followed by continuous annealing to form a steel texture comprised of ferrite having an area ratio of 40 to 80% with respect to the whole texture, and a second phase constituted by tempered martensite, fresh martensite and bainite, wherein the total area ratio of the bainite and the tempered martensite to the second phase is 50 to 80%, and the aspect ratio of the fresh martensite is in the range of 1.0 to 1.5.

12 Claims, No Drawings

HIGH-STRENGTH COLD ROLLED STEEL SHEET AND METHOD FOR MANUFACTURING THE SAME

CROSS REFERENCE TO RELATED APPLICATIONS

This is the U.S. National Phase application of PCT/JP2018/008892, filed Mar. 8, 2018, which claims priority to Japanese Patent Application No. 2017-047361, filed Mar. 13, 2017, the disclosures of each of these applications being incorporated herein by reference in their entireties for all purposes.

FIELD OF THE INVENTION

The present invention mainly relates to a high-strength cold rolled steel sheet for use in strength members of automobile bodies and a method for manufacturing the same. Specifically, the present invention relates to a high-strength cold rolled steel sheet having tensile strength TS of not less than 780 MPa, small yield ratio YR, and a small anisotropy of a tensile characteristic, and a method for manufacturing the same.

BACKGROUND OF THE INVENTION

In recent years, there has been a strong demand for improvement in fuel efficiency intended for reduction in the $CO_2$ emission of automobiles from the viewpoint of protecting the global environment. There has been also a strong demand for improvement in the strength of automobile bodies from the viewpoint of securing passengers' safety. In response to these demands, moves have become active to attempt higher strength as well as thinning of steel sheets serving as raw materials for automobile bodies, and lighter weights and higher strength of automobile bodies.

However, higher strength of the raw material steel sheets tends to increase variation in mechanical characteristics such as yield stress and tensile strength (in-plane anisotropy). This variation deteriorates the dimensional accuracy of molded parts. Hence, it is important to reduce variation in the mechanical characteristics of high-strength steel sheets. Since higher strength generally elevates yield ratio YR, spring back after forming also gets large. Therefore, reduction in yield ratio is also important.

Accordingly, some techniques have been proposed in response to reduction in variation in the mechanical characteristics of high-strength steel sheets and reduction in yield ratio. For example, Patent Literature 1 discloses a technique of decreasing the in-plane anisotropy of yield strength by setting a three-dimensional crystal orientation distribution function to not more than 2.5 at $\{\phi1, \Phi, \phi2\}=\{0°, 35°, 45°\}$ of a steel sheet containing 0.06 to 0.12 mass % of C and 1.2 to 2.6 mass % of Mn, preparing a steel sheet texture as a principal phase of ferrite, and controlling the volume fraction of a martensite phase to 5 to 20% with respect to the whole texture.

Patent Literature 2 discloses a technique of suppressing variation in mechanical characteristic by adding Al: 0.5 to 1.5 mass % to a steel sheet containing C: 0.06 to 0.15 mass %, Si: 0.5 to 1.5 mass %, and Mn: 1.5 to 3.0 mass %, and expanding a two-phase temperature range of $Ac_1$ to $Ac_3$, thereby decreasing change in texture ascribable to fluctuations in continuous annealing conditions.

Patent Literature 3 discloses a technique of improving stretch-flanging property and bendability by adding Cr: 0.3 to 1.3 mass % to a steel sheet having C: 0.03 to 0.17 mass % and Mn: 1.5 to 2.5 mass %, and enhancing hardenability in a cooling process after soaking annealing while softening generated martensite.

Patent Literature 4 discloses a technique of obtaining a high-strength steel sheet having a low yield ratio and excellent strain aging resistance and uniform elongation, the high-strength steel sheet containing C: 0.06 to 0.12 mass %, Mn: 1.2 to 3.0 mass %, Nb: 0.005 to 0.07 mass % and Ti: 0.005 to 0.025 mass %, and having a metal texture consisting of a two-phase texture of bainite and a martensite-austenite constituent, wherein the area fraction of the martensite-austenite constituent is 3 to 20%, and a circle-equivalent diameter is not more than 3.0 μm.

PATENT LITERATURE

Patent Literature 1: JP-A-2013-181183
Patent Literature 2: JP-A-2007-138262
Patent Literature 3: JP-A-2010-070843
Patent Literature 4: JP-A-2011-094230

SUMMARY OF THE INVENTION

However, a problem of the technique of Patent Literature 1 described above is that strength in terms of a tensile strength of not less than 780 MPa cannot be secured even by a two-phase texture of ferrite and martensite because the fraction of the martensite phase is not more than 20%.

The technique of Patent Literature 2 described above requires adding a large amount of Al and also requires special cooling equipment for cooling from 750 to 500° C. at a cooling rate of not more than 20° C./s after soaking annealing, followed by rapid cooling to not higher than 100° C. at a rate of not less than 100° C./s. Therefore, a large capital investment is necessary for the practical realization of the technique.

A problem of the technique of Patent Literature 3 described above is large difference in hardness among microstructures, which facilitates fluctuations in strength, because of a steel texture free from bainite. In addition, variation in the mechanical characteristics of steel sheets is not taken into consideration.

The technique of Patent Literature 4 described above is directed to a thick sheet as the target of the invention and is thus difficult to apply to high-strength cold rolled steel sheets for automobiles which are manufactured by cold rolling and continuous annealing.

Accordingly, the present invention has been made in light of the problems of the conventional techniques described above. An object of the present invention is to provide a high-strength cold rolled steel sheet having a tensile strength of not less than 780 MPa, a low yield ratio, and a small anisotropy of a tensile characteristic, and to provide an advantageous method for manufacturing the same.

The inventors have conducted diligent studies to solve the above problems. As a result, the inventors have found out that, in order to obtain a high-strength cold rolled steel sheet having a tensile strength of not less than 780 MPa, a low yield ratio, and a small anisotropy of a tensile characteristic, it is effective to prepare a steel texture having a main phase of ferrite and a second phase consisting of bainite, tempered martensite and fresh martensite, wherein the total area ratio of the bainite and the tempered martensite to the second phase is 50 to 80% and the aspect ratio of the fresh martensite is in the range of 1.0 to 1.5, by allowing the recrystallization of ferrite to proceed sufficiently in soaking annealing during continuous annealing after cold rolling while generating a proper amount of austenite and then properly controlling subsequent cooling conditions, whereby an embodiment of the invention is accomplished.

The present invention based on the findings described above provides a high-strength cold rolled steel sheet characterized by having: a chemical composition comprising C: 0.07 to 0.12 mass %, Si: not more than 0.7 mass %, Mn: 2.2 to 2.8 mass %, P: not more than 0.1 mass %, S: not more than 0.01 mass %, Al: 0.01 to 0.1 mass %, N: not more than 0.015 mass %, one or two selected from Ti and Nb: 0.02 to 0.08 mass % in total, and the residue being Fe and inevitable impurities;

a steel texture comprised of ferrite having an area ratio of 40 to 80% with respect to the whole texture, and a second phase constituted by tempered martensite, fresh martensite and bainite, wherein the total area ratio of the bainite and the tempered martensite to the second phase is 50 to 80%, and the aspect ratio of the fresh martensite is in the range of 1.0 to 1.5;

and mechanical characteristics having a tensile strength of not less than 780 MPa, a yield ratio of not more than 70%, an absolute value of not more than 30 MPa as in-plane anisotropy ΔYS of yield stress defined by the following equation (1):

$$|\Delta YS|=(YS_L-2\times YS_D+YS_C)/2 \quad (1)$$

and an absolute value of not more than 30 MPa as in-plane anisotropy ΔTS of tensile strength defined by the following equation (2):

$$|\Delta TS|=(TS_L-2\times TS_D+TS_C)/2 \quad (2).$$

In the equations (1) and (2), $YS_L$ and $TS_L$ represent yield stress and tensile strength, respectively, in the rolling direction, and $YS_C$ and $TS_C$ represent yield stress and tensile strength, respectively, in a direction perpendicular to the rolling direction, and $YS_D$ and $TS_D$ represent yield stress and tensile strength, respectively, in a direction of 45° with respect to the rolling direction.

The high-strength cold rolled steel sheet according to an embodiment of the present invention is characterized in that the average particle size of carbide in the bainite is not more than 0.3 μm, and the average particle size of the fresh martensite is not more than 1.0 μm.

The high-strength cold rolled steel sheet according to an embodiment of the present invention is characterized by further containing one or two or more selected from Cr: 0.05 to 1.0 mass %, Mo: 0.05 to 1.0 mass % and V: 0.01 to 0.1 mass %, in addition to the chemical composition.

The high-strength cold rolled steel sheet according to an embodiment of the present invention is characterized by further containing B: 0.0003 to 0.005 mass % in addition to the chemical composition.

The present invention in accordance with various embodiments also provides a method for manufacturing a high-strength cold rolled steel sheet, comprising hot rolling a steel slab having any one of the chemical compositions described above, cold rolling the steel sheet, and conducting continuous annealing to manufacture a high-strength cold rolled steel sheet, characterized in that the continuous annealing includes soaking treatment for holding in a temperature range of $Ac_3$−30° C. to $Ac_3$+50° C. for not less than 60 seconds, then primary cooling from the soaking temperature to not higher than 650° C. at an average cooling rate of 2 to 5° C./s, primary retention in a temperature range of 650 to 550° C. for 15 to 60 seconds, then secondary cooling from the retention temperature to a temperature range of not higher than 350° C. at an average cooling rate of 10 to 25° C./s, and secondary retention in a temperature range of 350 to 250° C. for 300 to 500 seconds, followed by tertiary cooling to thereby confer: a steel texture comprised of ferrite having an area ratio of 40 to 80% with respect to the whole texture, and a second phase constituted by tempered martensite, fresh martensite and bainite, wherein the total area ratio of the bainite and the tempered martensite to the second phase is 50 to 80%, and the aspect ratio of the fresh martensite is in the range of 1.0 to 1.5; and mechanical characteristics having a tensile strength of not less than 780 MPa, a yield ratio of not more than 70%, an absolute value of not more than 30 MPa as in-plane anisotropy ΔYS of yield stress defined according to the following equation (1):

$$|\Delta YS|=(YS_L-2\times YS_D+YS_C)/2 \quad (1)$$

and an absolute value of not more than 30 MPa as in-plane anisotropy ΔTS of tensile strength defined according to the following equation (2):

$$|\Delta TS=(TS_L-2\times TS_D+TS_C)/2 \quad (2).$$

In the equations (1) and (2), $YS_L$ and $TS_L$ represent yield stress and tensile strength, respectively, in the rolling direction, and $YS_C$ and $TS_C$ represent yield stress and tensile strength, respectively, in a direction perpendicular to the rolling direction, and $YS_D$ and $TS_D$ represent yield stress and tensile strength, respectively, in a direction of 45° with respect to the rolling direction.

The high-strength cold rolled steel sheet according to embodiments of the present invention has a tensile strength of not less than 780 MPa, a low yield ratio and a small anisotropy of a tensile characteristic and therefore not only contributes to improvement in formability and improvement in the dimensional accuracy of formed parts but also make a great contribution to improvement in fuel efficiency by lighter weights of car bodies and improvement in safety by higher strength, when applied to high-strength members of automobile bodies.

DETAILED DESCRIPTION OF EMBODIMENTS OF THE INVENTION

The mechanical characteristics of the high-strength cold rolled steel sheet which is the target of the present invention (hereinafter, also simply referred to as the "steel sheet according to an embodiment of the present invention") will be first described.

The steel sheet according to an embodiment of the present invention has mechanical characteristics having tensile strength TS of not less than 780 MPa, yield ratio YR of not more than 70% which is the ratio of yield stress YS to tensile strength TS (YS/TS×100), absolute value |ΔYS| of not more than 30 MPa as an in-plane anisotropy of yield stress YS defined according to the following equation (1):

$$|\Delta YS|=(YS_L-2\times YS_D+YS_C)/2 \quad (1)$$

and absolute value |TS| of not more than 30 MPa as an in-plane anisotropy of tensile strength TS defined according to the following equation (2):

$$|\Delta TS|=(TS_L-2\times TS_D+TS_C)/2 \quad (2).$$

In this context, the tensile strength TS and the yield ratio YR are values in a direction perpendicular to the rolling direction (direction C). In the equations (1) and (2), $YS_L$ and $TS_L$ represent yield stress and tensile strength, respectively, in the rolling direction, and $YS_C$ and $TS_C$ represent yield stress and tensile strength, respectively, in a direction perpendicular to the rolling direction, and $YS_D$ and $TS_D$ represent yield stress and tensile strength, respectively, in a direction of 45° with respect to the rolling direction.

The upper limit of the tensile strength TS of the steel sheet according to an embodiment of the present invention is not particularly specified and is on the order of 1200 MPa. This is because the tensile strength of 1200 MPa is the limit to the chemical components and steel texture configuration of the present invention.

An excellent feature of the steel sheet of the present invention is that uniform elongation in a direction perpendicular to the rolling direction (direction C) is not less than 10%.

Next, the steel texture of the high-strength cold rolled steel sheet according to an embodiment of the present invention will be described.

In order to have the mechanical characteristics described above, the steel texture of the steel sheet according to an embodiment of the present invention needs to comprise ferrite having an area ratio of 40 to 80% with respect to the whole texture, and a second phase constituted by bainite, tempered martensite and fresh martensite, wherein the total area ratio of the bainite and the tempered martensite to the second phase is 50 to 80%, and the aspect ratio of the fresh martensite is in the range of 1.0 to 1.5. Such coexistence of ferrite as the principal phase and the second phase consisting of bainite, tempered martensite and fresh martensite can provide mechanical characteristics having a low yield ratio and a small anisotropy of a tensile characteristic in spite of strength as high as a tensile strength of not less than 780 MPa. Hereinafter, the reason for limiting the steel texture will be specifically described.

Area Ratio of Ferrite: 40 to 80%

The steel texture of the steel sheet according to an embodiment of the present invention is constituted with a composite texture in which a low-temperature transformation phase (bainite, tempered martensite and fresh martensite) exists as a second phase in soft ferrite having excellent ductility. The area ratio of the ferrite to the steel texture needs to be not less than 40% to secure sufficient ductility and the balance between strength and ductility. On the other hand, when the area ratio of the ferrite exceeds 80%, it is difficult to secure the tensile strength (not less than 780 MPa) intended by the present invention. Accordingly, the area ratio of the ferrite is in the range of 40 to 80%. Preferably, the area ratio of the ferrite is in the range of 45 to 75%.

In the steel texture of the steel sheet according to an embodiment of the present invention, a residue excluding the ferrite is a second phase constituted by tempered martensite, fresh martensite and bainite (low-temperature transformation phase). Thus, the area ratio of the second phase is a value determined by subtracting the ferrite area ratio mentioned above from 100%. Residual austenite, pearlite and carbide, which are textures other than ferrite and the second phase described above, can be contained as long as the total area ratio thereof is not more than 2%.

In this context, the bainite is a texture having hardness intermediate between ferrite and fresh martensite and is effective for reducing the anisotropy of a tensile characteristic. Therefore, the bainite preferably exists at an area ratio of 10 to 30% with respect to the whole steel sheet texture. The amount of the bainite can be achieved by generating a predetermined amount of ferrite through primary retention at a temperature from 650 to 550° C. in a heat treatment process mentioned later. The amount of the bainite is more preferably less than 30%, further preferably not more than 20%.

The tempered martensite is an important texture to secure favorable bendability and stretch-flanging property and preferably exists in an area ratio of 20 to 50% with respect to the whole steel sheet texture.

The fresh martensite is an as-quenched martensite texture that is formed at a final stage of a cooling process of continuous annealing, as mentioned later, and is effective for reducing the yield ratio of the steel sheet. In order to obtain this effect, the fresh martensite preferably exists at an area ratio of not less than 5% with respect to the whole steel sheet texture. However, a large amount of fresh martensite existing increases the amount of voids formed at the boundary surface between the fresh martensite and ferrite at the time of press-forming and easily causes press cracking. Therefore, the area ratio of the fresh martensite is preferably not more than 30%. The area ratio of the fresh martensite is more preferably in the range of 10 to 20%.

Total Area Ratio of Bainite and Tempered Martensite to Second Phase: 50 to 80%

It is important in the steel sheet according to an embodiment of the present invention that the total area ratio of the bainite and the tempered martensite to the area ratio of the second phase falls within the range of 50 to 80%, from the viewpoint of reducing the anisotropy of a tensile characteristic. When the total area ratio of the bainite and the tempered martensite to the second phase is less than 50%, not only is the anisotropy of a tensile characteristic increased but the bendability or stretch-flanging property of the steel sheet is reduced. On the other hand, when the total area ratio exceeds 80%, it is difficult to secure the tensile strength of not less than 780 MPa, and in addition, the yield ratio is substantially increased. Preferably, the total area ratio is in the range of 55 to 75%.

The total area ratio of the bainite and the tempered martensite to the second phase is determined by measuring the area ratio of the fresh martensite by the method mentioned above, subtracting the area ratio of the fresh martensite from the area ratio of the second phase, and dividing the resulting area ratio by the total area ratio of the second phase.

The area ratio of each phase described above is an average value from 3 fields of view when the area ratio of each phase is measured using Adobe Photoshop (Adobe Systems Inc.) as to a texture image obtained by polishing a sheet thickness cross section (L-section) in the rolling direction of the steel sheet, etching the cross section with a 1 vol % nital solution, and then photographing a position of ¼ in the sheet thickness from the steel sheet surface in the range of 40 μm×28 μm with a SEM (scanning electron microscope) in 3 fields of view at a magnification of 1000. The tempered martensite refers to a phase containing carbide having an average particle size of less than 0.1 μm. The bainite refers to a phase containing carbide having an average particle size of not less than 0.1 μm.

Aspect Ratio of Fresh Martensite: 1.0 to 1.5

For the steel sheet of the present invention, the form of the fresh martensite is also important. When the ratio of the second phase having a form extending in the rolling direction increases, voids occur easily at the time of in press-forming. In addition, cracks also progress easily. Thus, the aspect ratio of the fresh martensite needs to be in the range of 1.0 to 1.5. Preferably, it is in the range of 1.0 to 1.3. The aspect ratio of the fresh martensite is defined according to (length of the major axis/length of the minor axis). In the steel sheet of the present invention, the "length of the major axis" refers to the "length of the fresh martensite in the rolling direction of the steel sheet", and the "length of the minor axis" refers to the "length of the fresh martensite in the thickness direction of the steel sheet".

The aspect ratio of the fresh martensite can be decreased by adjusting the soaking annealing temperature of continuous annealing in a manufacturing method mentioned later from a high-temperature range of a ($\alpha+\gamma$) two-phase range to a $\gamma$ single-phase range to completely delete an unrecrystallized texture, while generating a proper amount of austenite, then controlling conditions for primary cooling to a temperature range of not higher than 650° C. and primary retention in a temperature range of 650 to 550° C. to proper ranges, and decomposing and reducing in size the austenite generated at the time of soaking.

For the high-strength cold rolled steel sheet of the present invention, it is also preferred that the average particle size of the fresh martensite in the second phase should be not more than 1.0 μm, and the average particle size of carbide precipitated in the bainite should be not more than 0.3 μm.

Average Particle Size of Fresh Martensite: Not More Than 1.0 μm

The average particle size of the fresh martensite has an influence on press formability. When the average particle size exceeds 1.0 μm, voids are generated at the boundary surface between the fresh martensite and ferrite at the time of press-forming. This reduces uniform elongation and easily causes press cracking. Also, the anisotropy of a tensile characteristic depends on the average particle size of the fresh martensite. When the average particle size exceeds 1.0 μm, the anisotropy of a tensile characteristic tends to be increased. Accordingly, the average particle size of the fresh martensite is preferably not more than 1.0 μm. More preferably, it is not more than 0.8 μm.

The average particle size of the fresh martensite is determined by a cutting method when a region recognizable as a grain under SEM is defined as one grain.

Average Particle Size of Carbide in Bainite: Not More Than 0.3 μm

The average particle size of carbide in the bainite also has an influence on press formability. When the average particle size exceeds 0.3 μm, voids are easily generated at the boundary surface of the carbide at the time of press forming. This reduces uniform elongation and causes problems such as press cracking. Therefore, the average particle size of the carbide is preferably not more than 0.3 μm. More preferably, the average particle size of the carbide is not more than 0.2 μm. The lower limit of the average particle size of carbide in the bainite is 0.1 μm.

The aspect ratio and average particle size of the fresh martensite and the average particle size of carbide in the bainite depend largely on conditions for primary retention and secondary cooling subsequent thereto in the manufacturing process of the present invention mentioned later. Therefore, in order to control these values to the ranges mentioned above, it is important to control the conditions for primary retention and secondary cooling to proper ranges.

Next, the reason for limiting the chemical composition of the high-strength cold rolled steel sheet of the present invention will be described.

The steel sheet according to an embodiment of the present invention has basic chemical composition comprising C: 0.07 to 0.12 mass %, Si: not more than 0.7 mass %, Mn: 2.2 to 2.8 mass %, P: not more than 0.1 mass %, S: not more than 0.01 mass %, Al: 0.01 to 0.1 mass %, N: not more than 0.015 mass %, one or two selected from Ti and Nb: 0.02 to 0.08 mass % in total, and the residue consisting of Fe and inevitable impurities.

C: 0.07 to 0.12 Mass %

C is an element necessary for enhancing hardenability and securing a predetermined amount of the second phase (bainite, tempered martensite and fresh martensite). When C content is less than 0.07 mass %, the predetermined microstructure mentioned above cannot be obtained, and thus the yield ratio of not more than 70% cannot be attained, and in addition, it is difficult to secure the tensile strength of not less than 780 MPa. On the other hand, when C content exceeds 0.12 mass %, the second phase has an increased particle size and a decreased amount of the bainite generated, whereby the anisotropy of a tensile characteristic tends to be made large. Accordingly, the C content is in the range of 0.07 to 0.12 mass %. It is preferably not less than 0.08 mass %, more preferably not less than 0.09 mass %. Also, the C content is preferably not more than 0.11 mass %, more preferably not more than 0.10 mass %.

Si: Not More Than 0.7 Mass %

Si is a solid-solution strengthening element and improves workability such as uniform elongation. In order to obtain this effect, Si is preferably contained in an amount of not less than 0.1 mass %. However, Si content exceeding 0.7 mass % causes deterioration in surface properties ascribable to the occurrence of red scales or the like, or deterioration in chemical convertibility. Si is also a ferrite stabilizing element that increases the amount of ferrite generated in a temperature range of 550 to 650° C. and decreases the amount of the second phase generated. Therefore, it is difficult to secure the strength of not less than 780 MPa. Accordingly, the Si content is not more than 0.7 mass %. It is preferably not more than 0.60 mass %, more preferably not more than 0.50 mass %. The Si content is further preferably less than 0.30 mass %, still further preferably not more than 0.25 mass %.

Mn: 2.2 to 2.8 Mass %

Mn is an austenite stabilizing element and is an element necessary for securing the strength of the steel sheet because Mn suppresses the generation of ferrite and pearlite in a cooling process after soaking annealing in continuous annealing, and promotes the transformation of austenite into martensite, i.e., facilitates the generation of the second phase by enhancing hardenability. In order to obtain this effect, it is necessary to add not less than 2.2 mass % of Mn. Particularly, in the case of manufacturing the steel sheet using cooling equipment of gas jet cooling type which has a slower cooling rate than that of water hardening type, it is preferred to add a larger amount of Mn. On the other hand, when the Mn content exceeds 2.8 mass %, not only is spot weldability impaired but reduction in castability (slab cracks) is caused, or a yield ratio is elevated due to outstanding Mn segregation in the sheet thickness direction. Furthermore, such a Mn content suppresses ferrite generation in a temperature range of 550 to 650° C. in a cooling process after soaking annealing of continuous annealing, and in addition, suppresses the generation of bainite in a subsequent cooling process, leading to decrease in uniform elongation or increase in the anisotropy of a tensile characteristic. Accordingly, the Mn content is in the range of 2.2 to 2.8 mass %. It is preferably not less than 2.3 mass %, more preferably not less than 2.4 mass %. Also, the Mn content is preferably not more than 2.7 mass %, more preferably not more than 2.6 mass %.

P: Not More Than 0.1 Mass %

P is an element having large solid-solution strengthening ability and can be appropriately added according to the desired strength. However, when the amount of P added exceeds 0.1 mass %, not only is reduction in weldability incurred but embrittlement ascribable to grain boundary segregation leads to reduction in impact resistance. Accordingly, the P content is set to not more than 0.1 mass %. It is preferably not more than 0.05 mass %, more preferably not more than 0.03 mass %.

S: Not More Than 0.01 Mass %

S is an impurity element that inevitably contaminates steel in a refining process. A lower S content is more preferred because S causes hot brittleness due to grain boundary segregation and also forms a sulfide-based inclusion to reduce the locally deforming ability of the steel sheet. Hence, in an embodiment of the present invention, the S content is controlled to not more than 0.01 mass %. The S content is preferably not more than 0.005 mass %. It is more preferably not more than 0.002 mass %.

Al: 0.01 to 0.1 Mass %

Al is an element that is added as a deoxidizer in a steel refining process, and is also an element effective for suppressing the generation of carbide and promoting the generation of residual austenite. In order to obtain this effect, it is necessary to add not less than 0.01 mass % of Al. On the other hand, when the Al content exceeds 0.1 mass %, coarse AlN is precipitated to reduce ductility. Accordingly, the Al content is in the range of 0.01 to 0.1 mass %. It is preferably not less than 0.03 mass %. Also, the Al content is preferably not more than 0.06 mass %.

N: Not More Than 0.015 Mass %

N is an element that most heavily deteriorates the aging resistance of steel. In particular, when the N content exceeds 0.015 mass %, the deterioration in aging resistance is noticeable, so that the N content is controlled to not more than 0.015 mass %. A smaller amount of N is more desirable. The N content is preferably not more than 0.0100 mass %, more preferably not more than 0.0070 mass %. It is further preferably not more than 0.0050 mass %.

Ti and Nb: 0.02 to 0.08 Mass % in Total

Both Nb and Ti are elements effective for higher strength of steel because each element forms carbonitride in the steel to render crystal grains fine. In particular, in the case of carrying out the present invention in continuous annealing equipment having a cooling apparatus of gas jet cooling type, it is necessary to actively add Nb and Ti, to stably secure the tensile strength of not less than 780 MPa. Accordingly, in an embodiment of the present invention, one or two of Nb and Ti is added in an amount of not less than 0.02 mass % in total, in order to obtain the effect described above. On the other hand, when the total amount of Nb and Ti added exceeds 0.08 mass %, an unrecrystallized texture remains in the texture of a product sheet, so that the anisotropy of a tensile characteristic is large. Accordingly, the amount of Nb and Ti added is in the range of 0.02 to 0.08 mass % in total. The total amount of Nb and Ti added is preferably not less than 0.03 mass %. It is also preferably not more than 0.05 mass %.

The steel sheet of the present invention can further contain one or two or more selected from Cr: 0.05 to 1.0 mass %, Mo: 0.05 to 1.0 mass %, V: 0.01 to 0.1 mass % and B: 0.0003 to 0.005 mass %, in addition to the essential components described above.

Each of Cr, Mo, V and B is effective for suppressing the generation of pearlite at the time of cooling from an annealing temperature and enhancing hardenability and can therefore be added according to the need. In order to obtain the effect, it is preferred to add one or two or more selected from Cr: not less than 0.05 mass %, M: not less than 0.05 mass %, V: not less than 0.01 mass % and B: not less than 0.0003 mass %. However, when the added amounts of Cr, Mo, V and B exceed 1.0 mass %, 1.0 mass % o, 0.1 mass % and 0.005 mass %, respectively, the increased amount of hard martensite causes the strength to get extremely high, and thus, workability necessary for the steel sheet cannot be obtained. Accordingly, in the case of adding Cr, Mo, V and B, it is preferred to add these elements in their respective ranges described above. The elements are more preferably Cr: not less than 0.1 mass %, Mo: not less than 0.1 mass %, V: not less than 0.03 mass % and B: not less than 0.0005 mass %. On the other hand, the elements are more preferably C: not more than 0.5 mass %, Mo: not more than 0.3 mass %, V: not more than 0.06 mass % and B: not more than 0.002 mass %.

In the high-strength cold rolled steel sheet of the present invention, a residue excluding the components described above is Fe and inevitable impurities. The steel sheet of the present invention may contain Cu, Ni, Sb, Sn, Co, Ca, W, Na and Mg as impurity elements as long as the total content thereof is not more than 0.01 mass %. Such a content does not impair the working effect of the present invention.

Next, a method for manufacturing the high-strength cold rolled steel sheet of the present invention will be described.

The steel sheet according to an embodiment of the present invention is manufactured by hot rolling a steel slab having the chemical composition described above to form a hot rolled sheet, cold rolling the hot rolled sheet to form a cold rolled sheet having a predetermined sheet thickness, and then subjecting the cold rolled sheet to continuous annealing under predetermined conditions specified by the present invention.

The steel slab serving as a raw material for the steel sheet of the present invention can be manufactured by secondarily refining steel blown in a converter or the like, in a vacuum degassing treatment apparatus or the like to have the predetermined chemical composition described above, and then using a conventional method known in the art such as an ingot making-blooming method or a continuous casting method. The manufacturing method is not particularly limited as long as neither considerable component segregation nor texture inhomogeneity occurs.

The subsequent hot rolling may be performed by directly rolling the as-casted high-temperature slab or by reheating the cooled slab in a furnace charged therewith and then rolling the resulting slab. Slab reheating temperature SRT is preferably not higher than 1300° C. because too high SRT increases scale loss due to oxidation. On the other hand, a temperature lower than 1200° C. increases rolling load in hot rolling and easily causes rolling troubles. Thus, the slab heating temperature preferably falls within the range of 1200 to 1300° C.

Finish rolling end temperature FT in the hot rolling is preferably not lower than 800° C. in order to obtain a texture preferred for a small in-plane anisotropy of a tensile characteristic of a product sheet. At a finish rolling end temperature of lower than 800° C., not only is the load of hot rolling increased but the rolling is performed in a ferrite range of not higher than Ara transformation point in a certain component systems, resulting in coarse grains in a surface layer. On the other hand, a finish rolling end temperature exceeding 950° C. promotes recrystallization at the time of hot rolling so that austenite cannot be rolled in an unrecrystallized state. Therefore, a ferrite texture is coarsened, and it is difficult to secure the predetermined strength. Accordingly, the finish rolling end temperature FT preferably falls within the range of 800 to 950° C.

Coiling temperature CT in the hot rolling is preferably in the range of 650 to 400° C. A coiling temperature exceeding 650° C. increases the ferrite particle size of the hot rolled sheet, and thus it is difficult to impart the desired strength to a product sheet, or surface defects of scales occur easily. On the other hand, a coiling temperature of lower than 400° C. elevates the strength of the hot rolled sheet and increases rolling load in cold rolling. This incurs reduction in productivity. Accordingly, the coiling temperature preferably falls within the range of 650 to 400° C.

It is preferred that the hot rolled sheet thus obtained should then be descaled by pickling and then cold-rolled at a rolling reduction of 40 to 80% to form a cold rolled steel sheet having a sheet thickness of 0.5 to 3.0 mm. When the rolling reduction of the cold rolling is small, a texture after subsequent annealing is inhomogeneous to easily render the anisotropy of a tensile characteristic large. Therefore, the rolling reduction is more preferably not less than 50%.

Subsequently, the cold rolled sheet having the predetermined sheet thickness is subjected to continuous annealing, which is the most important process in an embodiment of the present invention, in order to provide the steel texture and the mechanical characteristics described above. Heat treatment conditions will be described below.

Heat Treatment

This heat treatment includes soaking treatment for holding in a temperature range of $Ac_3-30°$ C. to $Ac_3+50°$ C. for not less than 60 seconds, cooling to not higher than 650° C. at an average cooling rate of 2 to 5° C./s (primary cooling), retention in a temperature range of 550 to 650° C. for 15 to 60 seconds (primary retention), cooling to not higher than 350° C. at an average cooling rate of 10 to 25° C./s (secondary cooling), and retention in a temperature range of 350 to 250° C. for 300 to 500 seconds (secondary retention), followed by tertiary cooling.

Heating Conditions

The heating condition to the soaking temperature preferably includes not more than 10° C./s in a temperature range of higher than 650° C., from the viewpoint of promoting recrystallization sufficiently. This is because a heating rate exceeding 10° C./s renders a steel sheet texture inhomogeneous after continuous annealing so that the anisotropy of a tensile characteristic is made large. The heating rate is more preferably not more than 8° C./s.

Soaking Treatment Conditions

It is necessary in the soaking treatment (soaking annealing) that the steel sheet is held in a temperature range of $Ac_3-30°$ C. to $Ac_3+50°$ C. for not less than 60 seconds to sufficiently recrystallizing a ferrite rolling texture formed by the cold rolling and also to cause transformation into austenite necessary for forming the second phase in the ferrite. When the soaking annealing temperature is lower than $Ac_3-30°$ C., a rolling texture extended in the rolling direction tends to remain so that the anisotropy of a tensile characteristic is made large. The lower limit of the soaking temperature is preferably $Ac_3-20°$ C. On the other hand, when the soaking annealing temperature exceeds $Ac_3+50°$ C., generated austenite is coarsened. Thus, the average particle size of fresh martensite to be generated by tertiary cooling exceeds 1.0 μm, and uniform elongation of not less than 10% cannot be obtained, resulting in reduction in formability. The upper limit of the soaking temperature is preferably $Ac_3+40°$ C. When the soaking annealing time is less than 60 seconds, the reversible transformation of ferrite into austenite does not proceed sufficiently. Thus, the desired strength might not be obtained because a predetermined amount of austenite cannot be secured. Alternatively, a large amount of residual unrecrystallized grains might reduce press formability or might render the anisotropy of tensile strength large. Hence, the soaking annealing time is not less than 60 seconds. The soaking annealing time is preferably not less than 100 seconds. When the soaking annealing time exceeds 500 seconds, the particle size of austenite is coarsened, and coarse martensite is liable to be generated in a steel sheet texture after continuous annealing. This not only deteriorates press formability but incurs increase in energy cost. Hence, the upper limit thereof is preferably 500 seconds.

The point $Ac_3$ may be determined by an experiment and can also be calculated according to the following equation:

$$\text{Point } Ac_3\ (°\text{ C.}) = 910 - 203\times[\text{C }\%]^{1/2} + 44.7\times[\text{Si }\%] - 30\times[\text{Mn }\%] + 700\times[\text{P }\%] + 400\times[\text{Al }\%] - 20\times[\text{Cu }\%] + 31.5\times[\text{Mo }\%] + 104\times[\text{V }\%] + 400\times[\text{Ti }\%]$$

In the equation, [X %] represents the content (mass %) of element X as a component of the steel sheet and is set to "0" when the element X is not contained.

Primary Cooling Conditions

It is necessary in the primary cooling following the soaking treatment to conduct cooling from the soaking annealing temperature to a primary cooling stop temperature of 650 to 550° C. at an average cooling rate of 2 to 5° C./s, in order to secure a predetermined amount of ferrite. When the average cooling rate is less than 2° C./s, the decomposition of austenite proceeds excessively during cooling so that ferrite is substantially generated before primary retention in a temperature range of 550 to 650° C. Thus, the desired strength cannot be obtained after annealing. On the other hand, when the average cooling rate exceeds 5° C./s, the decomposition of austenite is rather insufficient during cooling so that a predetermined ferrite fraction cannot be secured, and the low yield ratio of not more than 70% cannot be obtained. Accordingly, the average cooling rate of the primary cooling is in the range of 2 to 5° C./s.

The reason for setting the cooling stop temperature of the primary cooling to not higher than 650° C. is that the decomposition of austenite does not proceed at a temperature higher than 650° C. to increase the amount of austenite. As a result, the low yield ratio cannot be achieved due to too much amount of second phases consisting of hard bainite, fresh martensite and tempered martensite. However, when the end-point temperature of the primary cooling is lower than 550° C., the amount of ferrite generated is increased. Therefore, it is difficult to secure the tensile strength of not less than 780 MPa in a product sheet. Hence, the stop temperature of the primary cooling is preferably not lower than 550° C.

Primary Retention Conditions

The steel sheet after primary cooling then needs to be subjected to primary retention for retaining the steel sheet at the primary cooling stop temperature, i.e., in a temperature range of 550 to 650° C., for 15 to 60 seconds, in order to generate a predetermined amount of ferrite.

When the primary retention temperature exceeds 650° C., there is a possibility that the low yield ratio cannot be obtained due to a small amount of ferrite. On the other hand, when the primary retention temperature is lower than 550° C., there is a possibility that strength after annealing cannot be secured due to a large amount of ferrite. When the retention time in the temperature range described above is less than 15 seconds, the decomposition of austenite does not proceed to increase the amount of the second phase, and therefore the low yield ratio cannot be obtained. On the other hand, when the retention time exceeds 60 seconds, the decomposition of austenite proceeds too much so that the area ratio of ferrite is excessively large. Thus, a predetermined amount of the second phase cannot be secured, and it is difficult to obtain the tensile strength of not less than 780 MPa. Thus, the retention time in the temperature range of 550 to 650° C. is 15 to 60 seconds. It is preferably not less than 20 seconds. Also, the retention time in the temperature range is preferably not more than 50 seconds. The primary retention time refers to the total time for which the steel sheet exists in the temperature range of 550 to 650° C., irrespective of whether to be during cooling or during temperature retention.

Secondary Cooling Conditions

The cold rolled sheet after the primary cooling and the subsequent primary retention then needs to be subjected to secondary cooling which involves cooling from the primary retention temperature of 550 to 650° C. to a temperature of not higher than 350° C. at an average cooling rate of 10 to 25° C./s, to secure predetermined amounts of bainite and tempered martensite by transforming a portion of austenite remaining after the primary retention into bainite and/or martensite.

The lower limit of the stop temperature of the secondary cooling is preferably 250° C. which is the lower limit temperature of secondary retention to be performed after the secondary cooling.

The reason for setting the average cooling rate of the secondary cooling to 10 to 25° C./s is that a cooling rate of less than 10° C./s is so slow that the decomposition of austenite proceeds excessively during cooling and the area ratio of bainite and martensite is less than 30% of the whole texture so that the predetermined tensile strength cannot be secured. On the other hand, when the average cooling rate of the secondary cooling exceeds 25° C./s, the decomposition of austenite is rather insufficient during cooling so that the area ratio of bainite and martensite is excessively large. This drastically elevates tensile strength and also renders the anisotropy of a tensile characteristic large. Accordingly, the average cooling rate of the secondary cooling is in the range of 10 to 25° C./s. It is preferably not less than 15° C./s. Also, the average cooling rate of the secondary cooling is preferably not more than 20° C./s.

Secondary Retention Conditions

The secondarily cooled steel sheet then needs to be subjected to secondary retention in which the sheet is held in a temperature range of 350 to 250° C. for 300 to 500 seconds.

When the secondary retention temperature is higher than 350° C. and/or when the secondary retention time exceeds 500 seconds, the amount of bainite generated is increased, or tensile strength is reduced because the tempering of martensite generated by the secondary cooling proceeds excessively. Therefore, the low yield ratio cannot be obtained. On the other hand, when the secondary retention temperature falls below 250° C. and/or when the secondary retention time falls below 300 seconds, the tempering of martensite does not proceed sufficiently. Furthermore, this temperature range generates hard fresh martensite and increases the amount of fresh martensite too much in a product sheet. Therefore, the anisotropy of a tensile characteristic is large. Thus, the secondary retention is performed under conditions of holding in a temperature range of 350 to 250° C. for 300 to 500 seconds. The secondary retention time is preferably not less than 380 seconds. Also, the secondary retention time is preferably not more than 430 seconds. The secondary retention time refers to the total time for which the steel sheet exists in the temperature range of 350 to 250° C., irrespective of whether to be during cooling or during temperature holding.

Tertiary Cooling Conditions

The cold rolled sheet after the secondary cooling and the subsequent secondary retention then needs to be subjected to tertiary cooling for transforming austenite remaining after the secondary retention into martensite. The as-quenched martensite generated by the tertiary cooling refers to fresh martensite and is distinguished from the tempered martensite obtained by tempering in the secondary retention.

The steel sheet thus subjected to continuous annealing under the heat treatment conditions described above is a high-strength cold rolled steel sheet having: a steel texture comprising ferrite having an area ratio of 40 to 80% with respect to the whole texture, and a second phase constituted by tempered martensite, fresh martensite and bainite, wherein the total area ratio of the bainite and the tempered martensite to the second phase is 50 to 80%, and the aspect ratio of the fresh martensite is in the range of 1.0 to 1.5; and mechanical characteristics having a tensile strength of not less than 780 MPa, a yield ratio of not more than 70%, an absolute value of not more than 30 MPa as in-plane anisotropy ΔYS of yield stress defined according to the aforementioned equation (1), and an absolute value not more than of 30 MPa as in-plane anisotropy ΔTS of tensile strength defined according to the aforementioned equation (2).

The steel sheet after the continuous annealing may then be subjected to temper rolling at a rolling reduction of 0.1 to 1.0% and may also be subjected to surface treatment such as electrogalvanization.

EXAMPLES

A Steel indicated by symbols A to M having each chemical composition shown in Table 1 is manufactured and prepared into a steel slab by the continuous casting method. Then, the steel slab is hot-rolled under the conditions shown in Table 2 to form a hot rolled sheet having a sheet thickness of 3.2 mm. The hot rolled sheet is pickled and then cold-rolled to form a cold rolled sheet having a sheet thickness of 1.4 mm. Then, the cold rolled sheet is subjected to continuous annealing under the conditions shown in Table 2.

TABLE 1

| Steel | Chemical composition ingredients (mass %) | | | | | | | | | | | | | Transformation point (° C.) | | | |
|---|---|---|---|---|---|---|---|---|---|---|---|---|---|---|---|---|---|
| symbol | C | Si | Mn | P | S | Al | N | Ti | Nb | Cr | Mo | V | B | $Ac_3$ | Ms | Bs | Remarks |
| A | 0.084 | 0.03 | 2.45 | 0.014 | 0.0011 | 0.037 | 0.0044 | 0.022 | 0.025 | — | — | — | — | 812 | 442 | 587 | Invention steel |
| B | 0.084 | 0.62 | 2.46 | 0.017 | 0.0016 | 0.039 | 0.0039 | 0.023 | — | — | — | — | — | 842 | 434 | 586 | Invention steel |
| C | 0.086 | 0.55 | 2.51 | 0.023 | 0.0014 | 0.045 | 0.0037 | — | 0.023 | 0.05 | — | — | 0.0014 | 833 | 432 | 581 | Invention steel |
| D | 0.082 | 0.25 | 2.55 | 0.015 | 0.0010 | 0.052 | 0.0035 | — | 0.025 | — | 0.05 | — | 0.0012 | 819 | 437 | 578 | Invention steel |

TABLE 1-continued

| Steel symbol | Chemical composition ingredients (mass %) | | | | | | | | | | | | | Transformation point (° C.) | | | Remarks |
|---|---|---|---|---|---|---|---|---|---|---|---|---|---|---|---|---|---|
| | C | Si | Mn | P | S | Al | N | Ti | Nb | Cr | Mo | V | B | $Ac_3$ | Ms | Bs | |
| E | 0.105 | 0.05 | 2.63 | 0.020 | 0.0011 | 0.058 | 0.0033 | — | 0.035 | — | — | 0.03 | — | 808 | 425 | 565 | Invention steel |
| F | 0.094 | 0.03 | 2.22 | 0.019 | 0.0009 | 0.040 | 0.0036 | 0.045 | 0.072 | — | 0.18 | — | 0.0008 | 835 | 444 | 605 | Invention steel |
| G | 0.113 | 0.04 | 2.55 | 0.024 | 0.0015 | 0.053 | 0.0049 | 0.011 | 0.015 | — | — | — | 0.0011 | 809 | 424 | 570 | Invention steel |
| H | 0.095 | 0.15 | 2.54 | 0.027 | 0.0016 | 0.044 | 0.0041 | 0.028 | — | — | — | — | 0.0012 | 826 | 432 | 576 | Invention steel |
| I | 0.061 | 1.10 | 2.55 | 0.027 | 0.0015 | 0.022 | 0.0044 | — | — | — | — | — | — | 860 | 438 | 584 | Comparative steel |
| J | 0.091 | 0.15 | 2.92 | 0.016 | 0.0009 | 0.027 | 0.0037 | — | — | — | — | — | — | 790 | 422 | 543 | Comparative steel |
| K | 0.106 | 0.03 | 2.11 | 0.022 | 0.0015 | 0.025 | 0.0048 | — | — | — | — | — | — | 807 | 441 | 611 | Comparative steel |
| L | 0.152 | 0.11 | 2.34 | 0.017 | 0.0017 | 0.046 | 0.0035 | — | — | — | — | — | — | 796 | 410 | 578 | Comparative steel |
| M | 0.045 | 0.05 | 2.54 | 0.024 | 0.0021 | 0.037 | 0.0038 | — | — | — | — | — | — | 825 | 460 | 589 | Comparative steel |

Test specimens are taken out from the annealed cold rolled annealing sheets thus obtained, and evaluated for their steel sheet textures and mechanical characteristics by the following procedures.

<Steel Sheet Texture>

A cross section of sheet thickness (L-section) in the rolling direction of each steel sheet is polished and then etched with a 1 vol % nital solution. A position of ¼ in the sheet thickness from the steel sheet surface is photographed in the range of 40 μm×28 μm by a SEM (scanning electron microscope) in 3 fields of view at a magnification of 1000. The area ratio of each phase, the aspect ratio of the fresh martensite, the average particle size of the fresh martensite, and the average particle size of carbide precipitated in the bainite are measured from the texture image using Adobe Photoshop (Adobe Systems Inc.). Averages from 3 fields of view were determined.

<Mechanical Characteristic>

Yield stress YS, tensile strength TS, uniform elongation and total elongation: JIS No. 5 test specimen is taken out from a direction perpendicular to the rolling direction of each steel sheet (direction C) and subjected to a tensile test in conformity to JIS Z 2241 to measure the items. Also, yield ratio YR is determined from the yield stress YS and the tensile strength TS obtained by the measurement as described above.

The tensile characteristic is evaluated as meeting an embodiment of the present invention when the tensile strength TS is not less than 780 MPa and the yield ratio Y is not more than 70%.

Anisotropy of tensile characteristic: JIS No. 5 test specimen is taken out from 3 directions, i.e., the rolling direction of each steel sheet (direction L), a direction of 45° with respect to the rolling direction (direction D) and a direction perpendicular to the rolling direction (direction C), and subjected to a tensile test in conformity to JIS Z 2241 to measure yield stress ($YS_L$, $YS_D$ and $YS_C$) and tensile strength ($TS_L$, $TS_D$ and $TS_C$) in each direction. The absolute value of an in-plane anisotropy of the yield stress YS was determined according to the following equation (1):

$$|\Delta YS|=(YS_L-2\times YS_D+YS_C)/2 \quad (1)$$

and the absolute value of an in-plane anisotropy of the tensile strength TS is determined according to the following equation (2):

$$|\Delta TS|=(TS_L-2\times TS_D+TS_C)/2 \quad (2).$$

The in-plane anisotropy of the tensile characteristic is evaluated as meeting an embodiment of the present invention when both $|\Delta YS|\leq 30$ MPa and $|\Delta TS|\leq 30$ MPa are satisfied.

The results of the evaluation described above are shown in Table 3. As seen from these results, all the steel sheets obtained by annealing a cold rolled sheet having chemical composition meeting an embodiment of the present invention, under continuous annealing conditions meeting an embodiment of the present invention have strength as high as tensile strength TS of not less than 780 MPa, yield ratio YR as low as not more than 70%, and absolute values of in-plane anisotropies of yield stress YS and tensile strength TS as small as not more than 30 MPa and can thus achieve the goal of the present invention.

TABLE 2-1

| Steel No. | Steel symbol | Hot rolling conditions | | | Thickness of cold rolled sheet (mm) | Continuous annealing conditions | | | |
|---|---|---|---|---|---|---|---|---|---|
| | | Heating temp. (° C.) | Finish rolling end temp. (° C.) | Coiling temp. (° C.) | | Average heating rate to 650° C. (° C./s) | Soaking temp. (° C.) | Soaking time (s) | Average cooling rate to primary cooling end temp. (° C./s) |
| 1 | A | 1230 | 870 | 540 | 1.4 | 10 | 830 | 100 | 3.0 |
| 2 | A | 1230 | 870 | 540 | 1.4 | 10 | 830 | 100 | 3.0 |
| 3 | A | 1230 | 870 | 540 | 1.4 | 10 | 800 | 100 | 3.0 |
| 4 | A | 1230 | 870 | 540 | 1.4 | 10 | 800 | 100 | 3.0 |
| 5 | A | 1230 | 870 | 540 | 1.4 | 10 | 800 | 100 | 3.0 |
| 6 | A | 1230 | 870 | 540 | 1.4 | 10 | 830 | 40 | 3.0 |
| 7 | A | 1230 | 870 | 540 | 1.4 | 10 | 830 | 100 | 1.0 |
| 8 | A | 1230 | 870 | 540 | 1.4 | 10 | 830 | 100 | 10.0 |
| 9 | A | 1230 | 870 | 540 | 1.4 | 10 | 830 | 100 | 3.0 |

TABLE 2-1-continued

| | | | | | | | | | |
|---|---|---|---|---|---|---|---|---|---|
| 10 | A | 1230 | 870 | 540 | 1.4 | 10 | 830 | 100 | 3.0 |
| 11 | B | 1230 | 870 | 540 | 1.4 | 10 | 845 | 100 | 3.0 |
| 12 | B | 1230 | 870 | 540 | 1.4 | 10 | 845 | 100 | 3.0 |
| 13 | B | 1230 | 870 | 540 | 1.4 | 10 | 845 | 100 | 3.0 |
| 14 | B | 1230 | 870 | 540 | 1.4 | 10 | 845 | 100 | 3.0 |
| 15 | B | 1230 | 870 | 540 | 1.4 | 10 | 845 | 100 | 3.0 |
| 16 | B | 1230 | 870 | 540 | 1.4 | 10 | 790 | 100 | 3.0 |

| | Continuous annealing conditions | | | | | |
|---|---|---|---|---|---|---|
| Steel No. | Primary cooling end temp. (° C.) | Retention time from 550 to 650° C. (s) | Average cooling rate to not lower than 350° C. (° C./S) | Secondary cooling end temp. (° C.) | Retention time from 350 to 250° C. (s) | Remarks |
| 1 | 600 | 30 | 15 | 300 | 400 | Invention Example |
| 2 | 600 | 30 | 15 | 340 | 400 | Invention Example |
| 3 | 600 | 30 | 12 | 300 | 400 | Comparative Example |
| 4 | 600 | 30 | 20 | 300 | 400 | Invention Example |
| 5 | 600 | 30 | 50 | 300 | 400 | Comparative Example |
| 6 | 600 | 30 | 15 | 300 | 400 | Comparative Example |
| 7 | 600 | 30 | 15 | 300 | 400 | Comparative Example |
| 8 | 600 | 30 | 15 | 300 | 400 | Comparative Example |
| 9 | 600 | 5 | 15 | 300 | 400 | Comparative Example |
| 10 | 600 | 75 | 15 | 300 | 400 | Comparative Example |
| 11 | 600 | 30 | 15 | 300 | 400 | Invention Example |
| 12 | 600 | 30 | 5 | 300 | 400 | Comparative Example |
| 13 | 600 | 30 | 35 | 300 | 400 | Comparative Example |
| 14 | 700 | 30 | 15 | 300 | 400 | Comparative Example |
| 15 | 500 | 30 | 15 | 300 | 400 | Comparative Example |
| 16 | 600 | 30 | 15 | 300 | 400 | Comparative Example |

TABLE 2-2

| | | | | | | Continuous annealing conditions | | | |
|---|---|---|---|---|---|---|---|---|---|
| | | Hot rolling conditions | | | Thickness | Average heating | | | Average cooling rate to primary |
| Steel No. | Steel symbol | Heating temp. (° C.) | Finish rolling end temp. (° C.) | Coiling temp. (° C.) | of cold rolled sheet (mm) | rate to 650° C. (° C./s) | Soaking temp. (° C.) | Soaking time (s) | cooling end temp. (° C./s) |
| 17 | C | 1230 | 870 | 540 | 1.4 | 15 | 845 | 100 | 3.0 |
| 18 | D | 1230 | 870 | 540 | 1.4 | 10 | 830 | 100 | 3.0 |
| 19 | E | 1230 | 870 | 540 | 1.4 | 10 | 820 | 100 | 3.0 |
| 20 | E | 1230 | 870 | 540 | 1.4 | 10 | 880 | 100 | 3.0 |
| 21 | F | 1230 | 870 | 540 | 1.4 | 10 | 850 | 100 | 3.0 |
| 22 | F | 1230 | 870 | 540 | 1.4 | 10 | 850 | 100 | 3.0 |
| 23 | F | 1230 | 870 | 540 | 1.4 | 10 | 850 | 100 | 3.0 |
| 24 | F | 1230 | 870 | 540 | 1.4 | 10 | 850 | 100 | 3.0 |
| 25 | F | 1230 | 870 | 540 | 1.4 | 10 | 850 | 100 | 3.0 |
| 26 | G | 1230 | 870 | 540 | 1.4 | 10 | 800 | 100 | 3.0 |
| 27 | H | 1230 | 870 | 540 | 1.4 | 10 | 850 | 100 | 3.0 |
| 28 | I | 1230 | 870 | 540 | 1.4 | 10 | 880 | 100 | 3.0 |
| 29 | J | 1230 | 870 | 540 | 1.4 | 10 | 820 | 100 | 3.0 |
| 30 | K | 1230 | 870 | 540 | 1.4 | 10 | 830 | 100 | 3.0 |
| 31 | L | 1230 | 870 | 540 | 1.4 | 10 | 830 | 100 | 3.0 |
| 32 | M | 1230 | 870 | 540 | 1.4 | 10 | 790 | 100 | 3.0 |

| | Continuous annealing conditions | | | | | |
|---|---|---|---|---|---|---|
| Steel No. | Primary cooling end temp. (° C.) | Retention time from 550 to 650° C. (s) | Average cooling rate to not lower than 350° C. (° C./S) | Secondary cooling end temp. (° C.) | Retention time from 350 to 250° C. (s) | Remarks |

TABLE 2-2-continued

| | | | | | | |
|---|---|---|---|---|---|---|
| 17 | 600 | 30 | 15 | 300 | 400 | Invention Example |
| 18 | 600 | 30 | 15 | 300 | 400 | Invention Example |
| 19 | 600 | 30 | 15 | 300 | 400 | Invention Example |
| 20 | 600 | 30 | 15 | 300 | 400 | Comparative Example |
| 21 | 600 | 30 | 15 | 300 | 400 | Invention Example |
| 22 | 600 | 30 | 15 | 200 | 7 | Comparative Example |
| 23 | 600 | 30 | 15 | 500 | 400 | Comparative Example |
| 24 | 600 | 30 | 15 | 300 | 150 | Comparative Example |
| 25 | 600 | 30 | 15 | 300 | 800 | Comparative Example |
| 26 | 600 | 30 | 25 | 300 | 400 | Invention Example |
| 27 | 600 | 30 | 15 | 300 | 400 | Invention Example |
| 28 | 600 | 30 | 15 | 300 | 400 | Comparative Example |
| 29 | 600 | 30 | 15 | 300 | 400 | Comparative Example |
| 30 | 600 | 30 | 15 | 300 | 400 | Comparative Example |
| 31 | 600 | 30 | 15 | 300 | 400 | Comparative Example |
| 32 | 600 | 30 | 15 | 300 | 400 | Comparative Example |

TABLE 3-1

| | | Steel sheet structure | | | | | | | | |
|---|---|---|---|---|---|---|---|---|---|---|
| | | Area ratio (%) | | | | | Aspect | Total ratio of | Average particle | Particle |
| Steel No. | Steel symbol | F | FM | B | TM | Total of second phase | ratio of FM (—) | B + TM in second phase (%) | size of carbide in B (μm) | size of FM (μm) |
| 1 | A | 44 | 15 | 5 | 36 | 56 | 1.2 | 73 | 0.2 | 0.5 |
| 2 | A | 46 | 12 | 9 | 33 | 54 | 1.2 | 78 | 0.2 | 0.6 |
| 3 | A | 64 | 11 | 1 | 24 | 36 | 1.4 | 69 | 0.2 | 0.7 |
| 4 | A | 60 | 16 | 4 | 20 | 40 | 1.4 | 60 | 0.2 | 0.7 |
| 5 | A | 58 | 25 | 2 | 15 | 42 | 1.6 | 40 | 0.2 | 0.6 |
| 6 | A | 45 | 16 | 6 | 33 | 55 | 1.5 | 71 | 0.2 | 1.1 |
| 7 | A | 81 | 8 | 3 | 8 | 19 | 1.3 | 58 | 0.2 | 0.7 |
| 8 | A | 39 | 15 | 6 | 40 | 61 | 1.3 | 75 | 0.2 | 0.6 |
| 9 | A | 32 | 21 | 6 | 41 | 68 | 1.3 | 69 | 0.2 | 1.1 |
| 10 | A | 83 | 9 | 1 | 7 | 17 | 1.2 | 47 | 0.2 | 0.8 |
| 11 | B | 47 | 16 | 7 | 30 | 53 | 1.3 | 70 | 0.1 | 0.8 |
| 12 | B | 46 | 10 | 9 | 35 | 54 | 1.3 | 81 | 0.1 | 0.8 |
| 13 | B | 42 | 25 | 4 | 29 | 58 | 1.3 | 57 | 0.1 | 0.7 |
| 14 | B | 38 | 14 | 6 | 42 | 62 | 2.3 | 77 | 0.1 | 1.4 |
| 15 | B | 56 | 29 | 5 | 10 | 44 | 1.3 | 34 | 0.1 | 0.9 |
| 16 | B | 55 | 35 | 1 | 9 | 45 | 1.7 | 22 | 0.1 | 0.7 |

| | Mechanical characteristic | | | | | | | |
|---|---|---|---|---|---|---|---|---|
| Steel No. | YS (MPa) | TS (MPa) | YR (%) | ΔYS (MPa) | ΔTS (MPa) | Uniform elongation (%) | Total elongation (%) | Remarks |
| 1 | 509 | 828 | 61 | 19 | 16 | 12 | 21 | Invention Example |
| 2 | 503 | 793 | 63 | 22 | 17 | 11 | 20 | Invention Example |
| 3 | 569 | 778 | 73 | 31 | 22 | 9 | 18 | Comparative Example |
| 4 | 518 | 847 | 61 | 25 | 19 | 10 | 20 | Invention Example |
| 5 | 475 | 851 | 56 | 32 | 18 | 11 | 21 | Comparative Example |
| 6 | 624 | 869 | 72 | 52 | 37 | 8 | 16 | Comparative Example |
| 7 | 465 | 728 | 64 | 33 | 17 | 12 | 21 | Comparative Example |
| 8 | 605 | 845 | 72 | 35 | 27 | 9 | 17 | Comparative Example |
| 9 | 538 | 872 | 62 | 32 | 25 | 9 | 18 | Comparative Example |
| 10 | 411 | 733 | 56 | 27 | 18 | 13 | 23 | Comparative Example |
| 11 | 523 | 854 | 61 | 18 | 15 | 12 | 21 | Invention Example |
| 12 | 605 | 828 | 73 | 38 | 26 | 8 | 17 | Comparative Example |
| 13 | 587 | 892 | 66 | 39 | 32 | 9 | 17 | Comparative Example |
| 14 | 609 | 887 | 69 | 31 | 22 | 9 | 19 | Comparative Example |
| 15 | 487 | 741 | 66 | 27 | 19 | 11 | 19 | Comparative Example |
| 16 | 589 | 867 | 68 | 45 | 32 | 7 | 16 | Comparative Example |

TABLE 3-2

| Steel No. | Steel symbol | Steel sheet structure: Area ratio (%) F | FM | B | TM | Total of second phase | Aspect ratio of FM (—) | Total ratio of B + TM in second phase (%) | Average particle size of carbide in B (μm) | Particle size of FM (μm) |
|---|---|---|---|---|---|---|---|---|---|---|
| 17 | C | 50 | 14 | 6 | 30 | 50 | 1.5 | 72 | 0.1 | 0.9 |
| 18 | D | 47 | 15 | 5 | 33 | 53 | 1.2 | 72 | 0.1 | 0.4 |
| 19 | E | 44 | 16 | 3 | 37 | 56 | 1.4 | 71 | 0.2 | 0.8 |
| 20 | E | 35 | 14 | 4 | 47 | 65 | 1.1 | 78 | 0.4 | 1.8 |
| 21 | F | 49 | 14 | 6 | 31 | 51 | 1.3 | 73 | 0.1 | 0.6 |
| 22 | F | 48 | 49 | 0 | 13 | 52 | 1.3 | 6 | 0.1 | 0.5 |
| 23 | F | 51 | 25 | 8 | 16 | 49 | 1.2 | 49 | 0.2 | 0.6 |
| 24 | F | 48 | 15 | 4 | 33 | 52 | 1.3 | 71 | 0.2 | 0.5 |
| 25 | F | 49 | 14 | 9 | 28 | 51 | 1.3 | 73 | 0.2 | 0.6 |
| 26 | G | 44 | 19 | 8 | 29 | 56 | 1.4 | 66 | 0.2 | 0.6 |
| 27 | H | 51 | 20 | 6 | 23 | 49 | 1.2 | 59 | 0.1 | 0.7 |
| 28 | I | 82 | 8 | 2 | 8 | 18 | 1.3 | 56 | 0.1 | 1.2 |
| 29 | J | 38 | 50 | 3 | 9 | 62 | 1.3 | 19 | 0.1 | 0.9 |
| 30 | K | 45 | 10 | 6 | 39 | 55 | 1.3 | 82 | 0.3 | 1.4 |
| 31 | L | 50 | 23 | 5 | 22 | 50 | 1.2 | 54 | 0.1 | 1.7 |
| 32 | M | 72 | 8 | 5 | 15 | 28 | 1.6 | 71 | 0.4 | 0.9 |

| Steel No. | Mechanical characteristic: YS (MPa) | TS (MPa) | YR (%) | ΔYS (MPa) | ΔTS (MPa) | Uniform elongation (%) | Total elongation (%) | Remarks |
|---|---|---|---|---|---|---|---|---|
| 17 | 545 | 834 | 65 | 28 | 21 | 11 | 21 | Invention Example |
| 18 | 560 | 842 | 67 | 24 | 18 | 10 | 20 | Invention Example |
| 19 | 603 | 924 | 65 | 26 | 19 | 10 | 19 | Invention Example |
| 20 | 624 | 914 | 68 | 35 | 31 | 8 | 17 | Comparative Example |
| 21 | 536 | 835 | 64 | 24 | 15 | 11 | 20 | Invention Example |
| 22 | 587 | 956 | 61 | 32 | 26 | 10 | 18 | Comparative Example |
| 23 | 531 | 850 | 62 | 32 | 25 | 11 | 19 | Comparative Example |
| 24 | 526 | 852 | 62 | 31 | 22 | 9 | 18 | Comparative Example |
| 25 | 578 | 779 | 74 | 29 | 20 | 10 | 22 | Comparative Example |
| 26 | 621 | 956 | 65 | 24 | 21 | 10 | 18 | Invention Example |
| 27 | 536 | 851 | 63 | 26 | 19 | 11 | 19 | Invention Example |
| 28 | 451 | 715 | 63 | 24 | 16 | 13 | 22 | Comparative Example |
| 29 | 624 | 1026 | 61 | 31 | 21 | 8 | 17 | Comparative Example |
| 30 | 624 | 835 | 75 | 27 | 18 | 9 | 19 | Comparative Example |
| 31 | 725 | 1106 | 66 | 31 | 32 | 6 | 12 | Comparative Example |
| 32 | 446 | 689 | 65 | 33 | 25 | 13 | 25 | Comparative Example |

The high-strength cold rolled steel sheet an embodiment of the present invention has strength as high as tensile strength TS of not less than 780 MPa, yield ratio YR as low as not more than 70%, and an absolute value of an in-plane anisotropy of a tensile characteristic as small as not more than 30 MPa and as such, can be suitably used for purposes required to have the characteristics described above without limitations to raw materials for high-strength members of automobile bodies.

The invention claimed is:

1. A high-strength cold rolled steel sheet characterized by having:

a chemical composition comprising C: 0.07 to 0.12 mass %, Si: not more than 0.7 mass %, Mn: 2.2 to 2.8 mass %, P: not more than 0.1 mass %, S: not more than 0.01 mass %, Al: 0.01 to 0.1 mass %, N: not more than 0.015 mass %, one or two selected from Ti and Nb: 0.02 to 0.08 mass % in total, and the residue being Fe and inevitable impurities;

a steel texture comprising ferrite having an area ratio of 40 to 80% with respect to the whole texture, and a second phase constituted by tempered martensite, fresh martensite and bainite, wherein the total area ratio of the bainite and the tempered martensite to the second phase is 50 to 80%, and the aspect ratio of the fresh martensite is in the range of 1.0 to 1.5; and mechanical characteristics having a tensile strength of 780-956 MPa, a yield ratio of not more than 70%, an absolute value of not more than 30 MPa as in-plane anisotropy ΔYS of yield stress defined according to the following equation (1), and an absolute value of not more than 30 MPa as in-plane anisotropy ΔTS of tensile strength defined according to the following equation (2):

$$|\Delta YS|=(YS_L-2\times YS_D+YS_C)/2 \quad (1)$$

$$|\Delta TS|=(TS_L-2\times TS_D+TS_C)/2 \quad (2)$$

wherein $YS_L$ and $TS_L$ represent yield stress and tensile strength, respectively, in the rolling direction, $YS_C$ and $TS_C$ represent yield stress and tensile strength, respectively, in a direction perpendicular to the rolling direction, and $YS_D$ and $TS_D$ represent yield stress and tensile strength, respectively, in a direction of 45° with respect to the rolling direction.

2. The high-strength cold rolled steel sheet according to claim 1, wherein the average particle size of carbide in the bainite is not more than 0.3 μm, and the average particle size of the fresh martensite is not more than 1.0 μm.

3. The high-strength cold rolled steel sheet according to claim 2, wherein the chemical composition of the high-strength cold rolled steel sheet further contains one or more selected from Cr: 0.05 to 1.0 mass %, Mo: 0.05 to 1.0 mass % and V: 0.01 to 0.1 mass %.

4. The high-strength cold rolled steel sheet according to claim 2, wherein the chemical composition of the high-strength cold rolled steel sheet further contains B: 0.0003 to 0.005 mass %.

5. The high-strength cold rolled steel sheet according to claim 1, wherein the chemical composition of the high-strength cold rolled steel sheet further contains one or more selected from Cr: 0.05 to 1.0 mass %, Mo: 0.05 to 1.0 mass % and V: 0.01 to 0.1 mass %, in addition to thc chcmical composition.

6. The high-strength cold rolled steel sheet according to claim 5, wherein the chemical composition the high-strength cold rolled steel sheet further contains B: 0.0003 to 0.005 mass %.

7. The high-strength cold rolled steel sheet according to claim 1, wherein the chemical composition of the high-strength cold rolled steel sheet further contains B: 0.0003 to 0.005 mass %.

8. The high-strength cold rolled steel sheet according to claim 7, wherein the chemical composition of the high-strength cold rolled steel sheet further contains B: 0.0003 to 0.005 mass %.

9. A method for manufacturing a high-strength cold rolled steel sheet, comprising hot rolling a steel slab having the chemical composition according to claim 1 to form a hot rolled sheet, cold rolling the hot rolled sheet, and conducting continuous annealing to manufacture a high-strength cold rolled steel sheet of claim 1, characterized in that the continuous annealing includes soaking treatment for holding in a temperature range of $Ac_3$−30° C. to $Ac_3$+50° C. for not less than 60 seconds, primary cooling from the soaking temperature to not higher than 650° C. at an average cooling rate of 2 to 5° C./s, primary retention in a temperature range of 650 to 550° C. for 15 to 60 seconds, then secondary cooling from the retention temperature to a temperature range of not higher than 350° C. at an average cooling rate of 10 to 25° C./s, and secondary retention in a temperature range of 350 to 250° C. for 300 to 500 seconds, followed by tertiary cooling to thereby confer:

a steel texture comprised of ferrite having an area ratio of 40 to 80% with respect to the whole texture, and a second phase constituted by tempered martensite, fresh martensite and bainite, wherein the total area ratio of the bainite and the tempered martensite to the second phase is 50 to 80%, and the aspect ratio of the fresh martensite is in the range of 1.0 to 1.5; and mechanical characteristics having a tensile strength of 780-956 MPa, a yield ratio of not more than 70%, an absolute value of not more than 30 MPa as in-plane anisotropy ΔYS of yield stress defined according to the following equation (1), and an absolute value of not more than 30 MPa as in-plane anisotropy ATS of tensile strength defined according to the following expression (2):

$$|\Delta YS|=(YS_L-2\times YS_D+YS_C)/2 \quad (1)$$

$$|\Delta TS|=(TS_L-2\times TS_D+TS_C)/2 \quad (2)$$

wherein $YS_L$ and $TS_L$ represent yield stress and tensile strength, respectively, in the rolling direction, $YS_C$ and $TS_C$ represent yield stress and tensile strength, respectively, in a direction perpendicular to the rolling direction, and $YS_D$ and $TS_D$ represent yield stress and tensile strength, respectively, in a direction of 45° with respect to the rolling direction.

10. The method for manufacturing a high- strength cold rolled steel sheet according to claim 9, wherein the chemical composition of the steel slab further contains one or more selected from Cr: 0.05 to 1.0 mass %, Mo: 0.05 to 1.0 mass % and V: 0.01 to 0.1 mass %.

11. The method for manufacturing a high-strength cold rolled steel sheet according to claim 10, wherein the chemical composition of the steel slab further contains B: 0.0003 to 0.005 mass %.

12. The method for manufacturing a high-strength cold rolled steel sheet according to claim 9, wherein the chemical composition of the steel slab further contains B: 0.0003 to 0.005 mass %.

* * * * *